US008081873B2

(12) United States Patent
Dannenberg et al.

(10) Patent No.: US 8,081,873 B2
(45) Date of Patent: Dec. 20, 2011

(54) HAIR DRYER MOUNT WITH OSCILLATING HOLDER FOR USE WITH A HAND-HELD HAIR DRYER

(75) Inventors: Jeff Dannenberg, Fort Lauderdale, FL (US); William J. Weiss, Deerfield Beach, FL (US); Carl J. Regan, Jr., Deerfield Beach, FL (US); Manuel Duarte, Deerfield Beach, FL (US); Hendrik A. Theron, Deerfield Beach, FL (US); Stephen J. King, Deerfield Beach, FL (US)

(73) Assignee: JRD International Enterprises, LLC, Fort Lauderdale, FL (US)

( * ) Notice: Subject to any disclaimer, the term of this patent is extended or adjusted under 35 U.S.C. 154(b) by 386 days.

(21) Appl. No.: 12/469,065

(22) Filed: May 20, 2009

(65) Prior Publication Data

US 2010/0012344 A1 Jan. 21, 2010

Related U.S. Application Data

(60) Provisional application No. 61/081,475, filed on Jul. 17, 2008.

(51) Int. Cl.
*A47J 27/00* (2006.01)
*F24H 3/02* (2006.01)

(52) U.S. Cl. ..... 392/381; 392/379; 392/380; 392/382; 248/278.1; 248/276.1

(58) Field of Classification Search ..... 248/276.1, 248/278.1; 392/379–382
See application file for complete search history.

(56) References Cited

U.S. PATENT DOCUMENTS

| | | | |
|---|---|---|---|
| 1,419,712 | A | 6/1922 | Bassette |
| 4,225,106 | A | 9/1980 | Eplan |
| 4,453,695 | A | 6/1984 | Sennott et al. |
| 4,691,451 | A | 9/1987 | Giorgis |
| 4,696,447 | A | 9/1987 | Strecker |
| 4,712,313 | A | 12/1987 | Gettleman |
| 4,746,090 | A | 5/1988 | Hamilton |
| D313,341 | S | 1/1991 | Gaboriault et al. |
| D314,502 | S | 2/1991 | Weldin |
| 5,018,697 | A | 5/1991 | Treanor et al. |
| 5,054,211 | A | 10/1991 | Shulman |

(Continued)

*Primary Examiner* — Thor Campbell
(74) *Attorney, Agent, or Firm* — Mark D. Bowen, Esq.; Malin Haley DiMaggio Bowen & Lhota, P.A.

(57) ABSTRACT

A hands-free hair dryer mounting apparatus adapted for holding a hair dryer in an oscillating universal hair dryer holder assembly is disclosed. The apparatus includes a wall mountable housing that is removably affixed to a wall mounting plate adapted for secure attachment to a wall or other supporting surface. A universal hair dryer holder, adapted for receiving and holding any type, size, or style of handheld hair dryer, projects outward from the housing. The hair dryer holder is connected to an oscillating arm via a horizontal pivot connection that allows for manual angular adjustment and affixation of the hair dryer about a generally horizontal pivot axis. The oscillating arm extends into the base and is connected to an electric motor by mechanical linkage such that angularly adjustable side-to-side oscillation is enabled. Angular adjustment is accomplished by providing the oscillating arm with an elongated longitudinal slot that receivably engages an eccentric motor driven axel, and by providing a manual adjustment lever that permits the user to selectively position the eccentric motor driven axel at various positions within the longitudinal slot thereby adjusting the angular displacement of the oscillating arm. The mounting base further includes a plurality of electrical outlets in electrical communication with the power source for providing power to the hair dryer as well as optional accessory devices, such as a curling iron.

6 Claims, 8 Drawing Sheets

U.S. PATENT DOCUMENTS

| | | | |
|---|---|---|---|
| 5,268,988 | A | 12/1993 | Miyamoto et al. |
| 5,350,144 | A | 9/1994 | Lary |
| 5,592,749 | A | 1/1997 | Trimmer |
| 5,842,670 | A | 12/1998 | Nigoghosian |
| 5,881,983 | A | 3/1999 | Hofmann et al. |
| 5,937,537 | A | 8/1999 | Miller |
| 5,940,980 | A | 8/1999 | Lee et al. |
| 5,956,861 | A | 9/1999 | Barnes |
| 6,061,923 | A | 5/2000 | Case |
| 6,199,805 | B1 | 3/2001 | Pena |
| 6,520,467 | B2 | 2/2003 | Thomas et al. |
| 7,077,370 | B2 | 7/2006 | Lin et al. |
| D568,708 | S | 5/2008 | Petruccelli |

HAIR DRYER MOUNT WITH OSCILLATING HOLDER FOR USE WITH A HAND-HELD HAIR DRYER

CROSS REFERENCE TO RELATED APPLICATIONS

This application claims the benefit of provisional U.S. Patent Application Ser. No. 61/081,475, filed on Jul. 17, 2008.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to apparatus for use with hand-held hair dryers, and more particularly to a hair dryer mounting apparatus having an adjustable oscillating hair dryer holder that provides the user with a hands free hair drying accessory.

2. Description of Related Art

A hair dryer, also frequently called a blow dryer, is an electromechanical device designed to blow cool or hot air over wet or damp hair, in order to accelerate the evaporation of water particles and dry the hair. When using the hair dryer the user typically holds the hair dryer in one hand and a styling brush or hair spray in the other. By requiring the user to hold the hair dryer this method of use significantly limits the user's range of motion while the limitation of the remaining hand limits the user's hair styling options.

As a result of the limitations and disadvantages present with the use of a conventional handheld hair dryer, the background art reveals a number of attempts directed to providing mounting systems for handheld hair dryers. For example, U.S. Pat. No. 7,077,370, issued to Lin et al. discloses a hair dryer stand for a handheld hair dryer that includes a base and a holder pivotally mounted to the base. The stand is adapted for mounting on a horizontal or vertical supporting surface and functions to simply hold the hair dyer in place. U.S. Pat. No. 6,199,805, issued to Pena, discloses a self supporting adjustable support stand for a portable hair dryer. The stand includes a base and a telescopically adjustable extension assembly for selective height adjustment, and elongated flexible connection, and a ring shaped holder for holding the hair dryer. U.S. Pat. No. 5,881,983, issued to Hofmann et al., discloses a hair dryer positioning system having a base and a bendable, shape retaining, dryer positioning arm terminating in a dryer cradle member.

U.S. Pat. No. 6,061,923, issued to Case, discloses a hair dryer holder for holding a hair dryer having a base and an adjustably extendable and retractable extension member attached to the base. The extension member terminates in a holding bracket comprising a generally horizontally disposed U-shaped member having a flexible strap extending across the open end thereof to hold the hair dryer with the aid of hook and loop fastening material. The device disclosed by Case, merely functions to hold the hair dryer in a fixed position, and thus exemplifies basic hair dryer mount/holder technology. Similarly, U.S. Pat. No. 4,453,695, issued to Sennott et al., discloses a hair dryer mount having a wall bracket extension arms, and a support that includes a strap which fits around the hair dryer. Other basic mounts and static hair dryer holders are disclosed in the following U.S. Pat. No. 6,52,0467, issued to Holder, for a Hair Dryer Holder; U.S. Pat. No. 4,696,447, issued to Strecker, for a Blow Dryer Holding Device; and U.S. Pat. No. 4,746,090, issued to Hamilton, for a Hair Dryer Holder; Des. U.S. Pat. No. 313,341, issued to Gaboriault et al., for a Hair Dryer Holder. The references listed above are primarily designed to hold a hair dryer in a fixed position. This limitation has resulted in the commercial success and widespread use of such devices.

U.S. Pat. No. 4,712,313, issued to Gettleman, discloses a hands free hair dryer holder for holding a hair dryer while in use that may include a mechanism that automatically swings the hair dryer up and down while in use to prevent excessive heat at one spot on the hair.

Automatically swinging the hair dryer up and down, however, causes warm air to be directed up and down the user's body thereby making the user hot and/or uncomfortable.

Accordingly, there exists a need for a hair dyer holding apparatus adapted for holding hair dryers of various shapes and further adapted to selectively oscillate the hair dryer as desired by the user.

BRIEF SUMMARY OF THE INVENTION

The present invention overcomes the limitations and disadvantages present in the art by providing a hands-free hair dryer mounting apparatus adapted for holding a hair dryer in an oscillating universal hair dryer holder assembly. The apparatus includes a wall mountable housing that is removably affixed to a wall mounting plate adapted for secure attachment to a wall or other supporting surface. A universal hair dryer holder, adapted for receiving and holding any type, size, or style of handheld hair dryer, projects outward from the housing. The hair dryer holder is connected to an oscillating arm via a horizontal pivot connection that allows for manual angular adjustment and affixation of the hair dryer about a generally horizontal pivot axis. The oscillating arm extends into the base and is connected to an electric motor by mechanical linkage such that angularly adjustable side-to-side oscillation is enabled. Angular adjustment is accomplished by providing the oscillating arm with an elongated longitudinal slot that receivably engages an eccentric motor driven axel, and by providing a manual adjustment lever that permits the user to selectively position the eccentric motor driven axel at various positions within the longitudinal slot thereby adjusting the angular displacement of the oscillating arm. The mounting base further includes a plurality of electrical outlets in electrical communication with the power source for providing power to the hair dryer as well as optional accessory devices, such as a curling iron. Finally, the base includes a pair of hooks that project therefrom to allow for accessories, such as a curling iron to be hung therefrom.

Accordingly, it is an object of the present invention to provide an improved hands-free holding apparatus for handheld hair dryers.

Another object of the present invention is to provide such an apparatus adapted with a universal hair dryer mount assembly.

Still another object of the present invention is to provide such an apparatus adapted to provide automatic hands-free oscillation of the hair dryer.

Yet another object of the present invention is to provide such an apparatus adapted for electrical connection to a remote electrical power outlet.

These and other objects are met by the present invention which will become more apparent from the accompanying drawing and the following detailed description of the drawings and preferred embodiments.

DETAILED DESCRIPTION OF THE INVENTION

Figure 1:
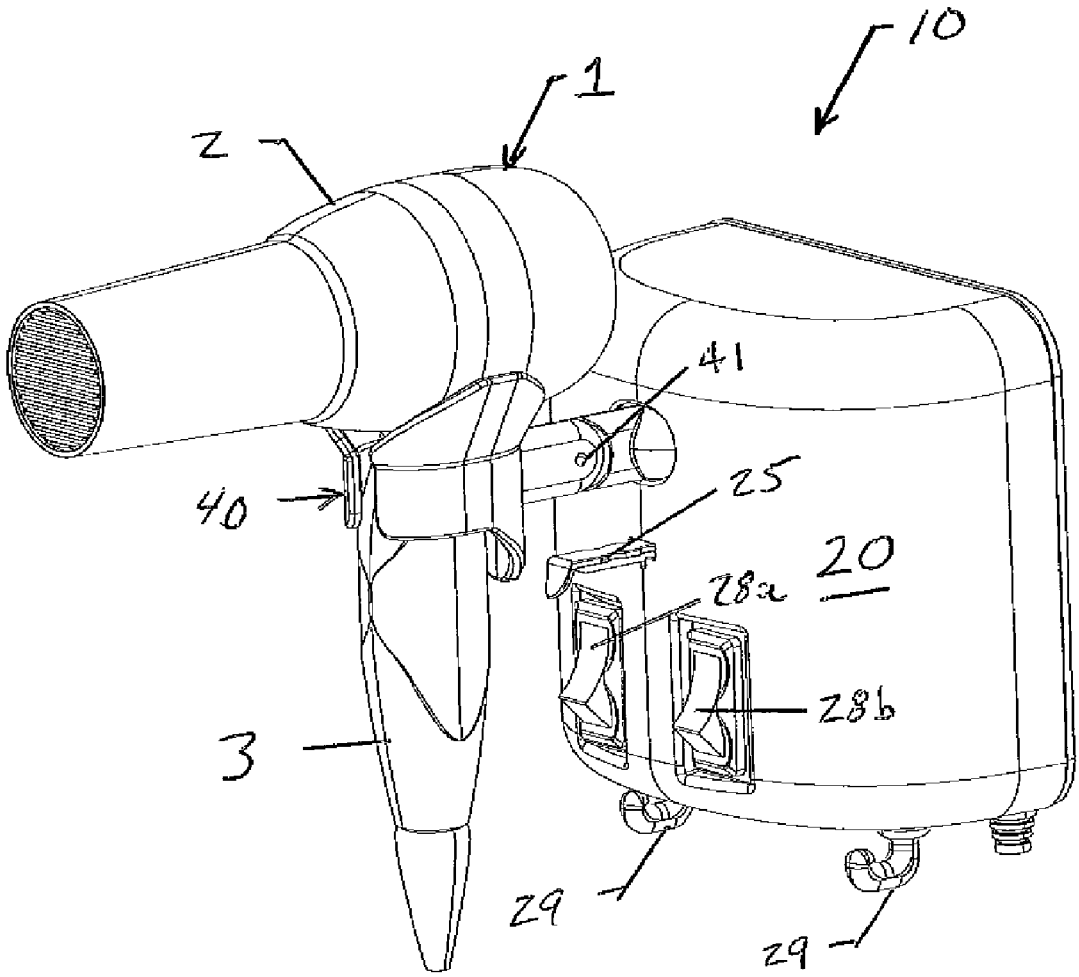
FIG. 1 is a front top perspective view of a hands-free hair dryer mounting apparatus shown holding a hair dryer in accordance with the present invention.

With reference now to the drawings, FIGS. 1-13 depict a hands-free hair dryer mounting apparatus, generally referenced as 10, adapted for holding a hair dryer, generally referenced as 1, in an oscillating universal hair dryer holder assembly in accordance with the present invention. Hair dryer 1 includes a main body 2 and a handle 3. Apparatus 10 generally includes a wall mountable housing 20 that has an electrically powered side-to-side oscillating aim 30 projecting therefrom. A universal hair dryer holder 40 having a generally Y-shaped configuration is connected to oscillating arm 20 formed to receive virtually any configuration of handheld hair dryer therein without the use of straps or clamps. The present invention thus provides a wall mountable apparatus that allows for hands free use of virtually any conventional hair dryer. In an alternate embodiment, hair dryer 1 may be incorporated into and integral with apparatus 10.

FIGS. 1-5 depict various views of a hair dryer mounting apparatus 10 with a hair dryer 1 operatively mounted thereto. Apparatus 10 apparatus includes a housing 20 that provides a platform for containing and/or connection of the remaining functional components. Housing 20 is preferably fabricated from plastic or any other suitable material, and defines a generally hollow internal volume for housing mechanical and electrical components. Housing 20 has a back plate 21 adapted for removable engagement with a mounting plate or bracket 22 adapted for affixation to a wall or other supporting surface via fasteners. Back plate 21 is adapted for slidable engagement with bracket 22, and a spring clip 23 on mounting plate 22 engages an aperture 24 on back plate 21 to stop further relative movement of back plate 21 relative to bracket 22 in the vertically downward direction. Spring clip 23 has an angled lower surface such that apparatus 10 may be simply removed by sliding the apparatus upward whereby the angles lower surface causes spring clip 23 to move out of aperture 24 thereby allowing apparatus 10 to be disengaged from mounting plate 22. In an alternate embodiment, apparatus 10 further includes a picture frame (not shown) designed to slidable engage bracket 22 such that the bracket may be concealed. This feature is considered a significant advancement in the art as it allows for the quick and easy removal of the housing and concealment of the mounting bracket. Such a feature is considered highly desirable, particularly in upscale residences.

Figure 2:
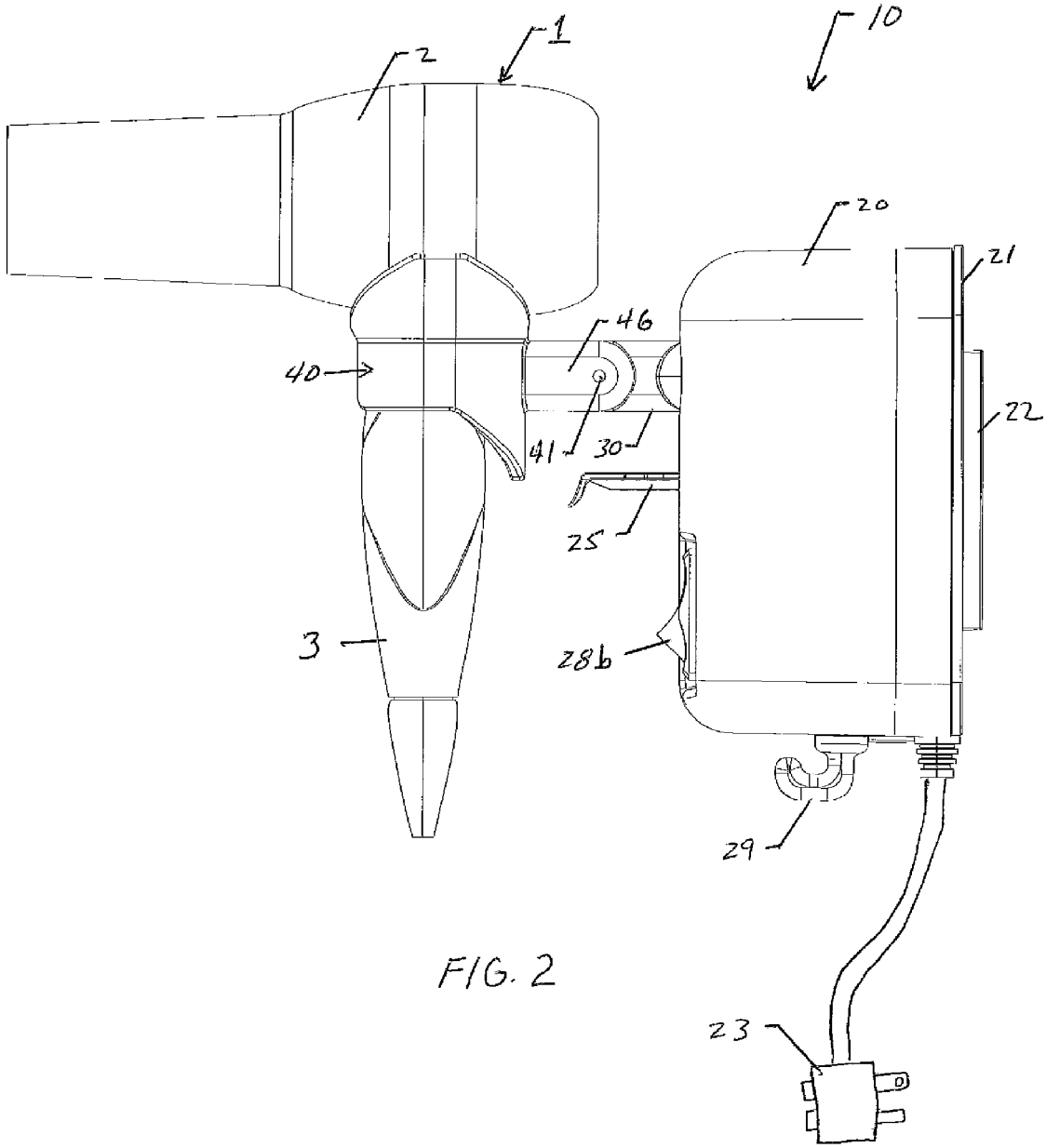
FIG. 2 is a side view thereof.
Figure 3:
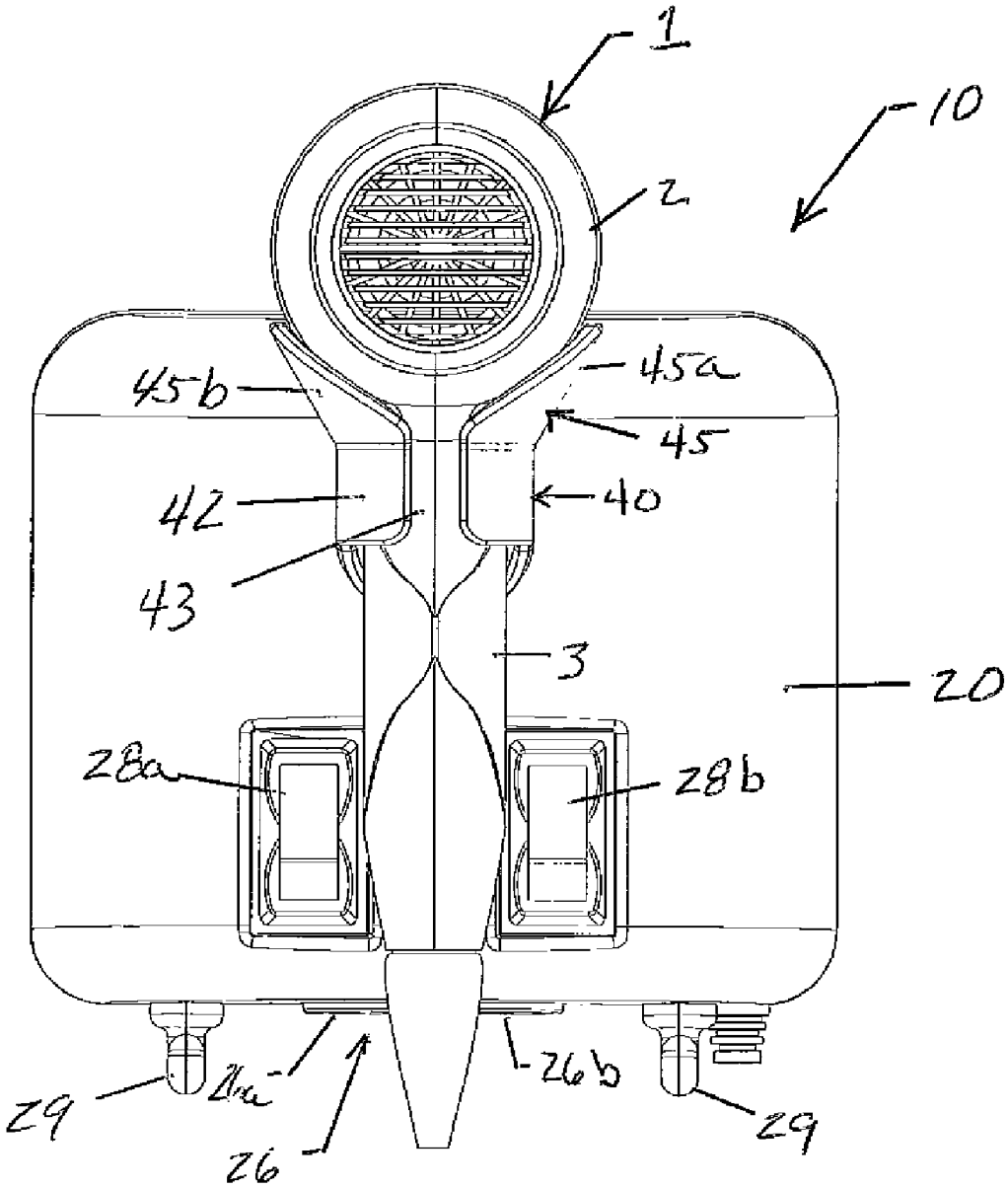
FIG. 3 is a front view thereof.
Figure 4:
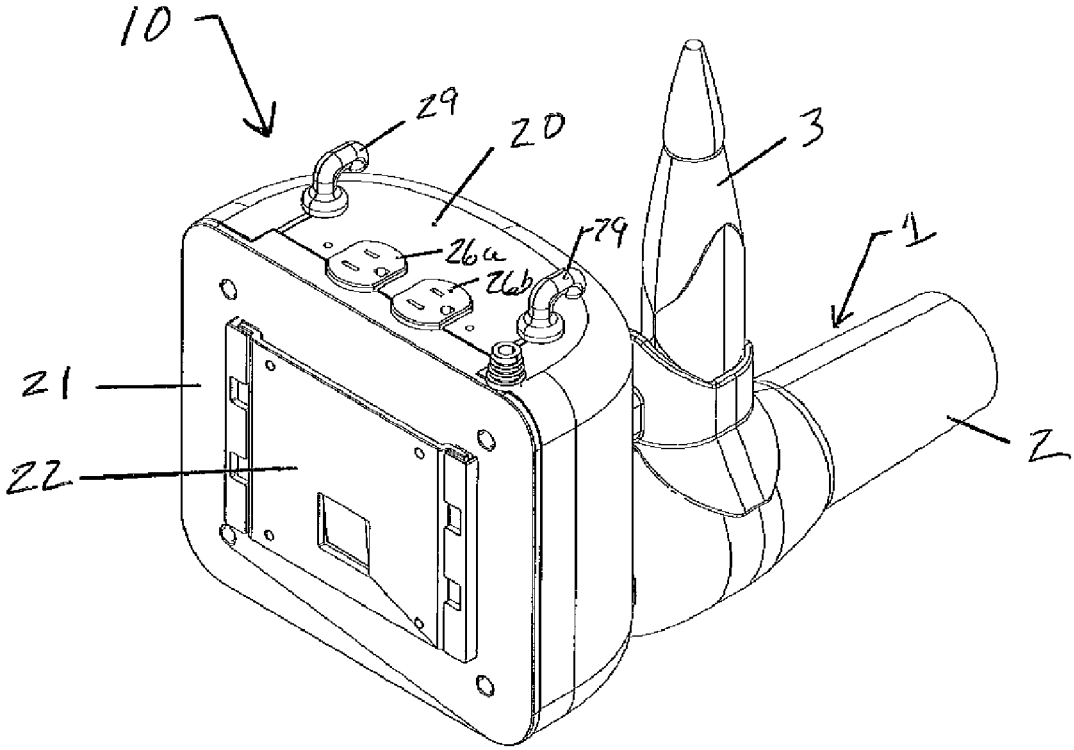
FIG. 4 is a bottom perspective view thereof.
Figure 5:
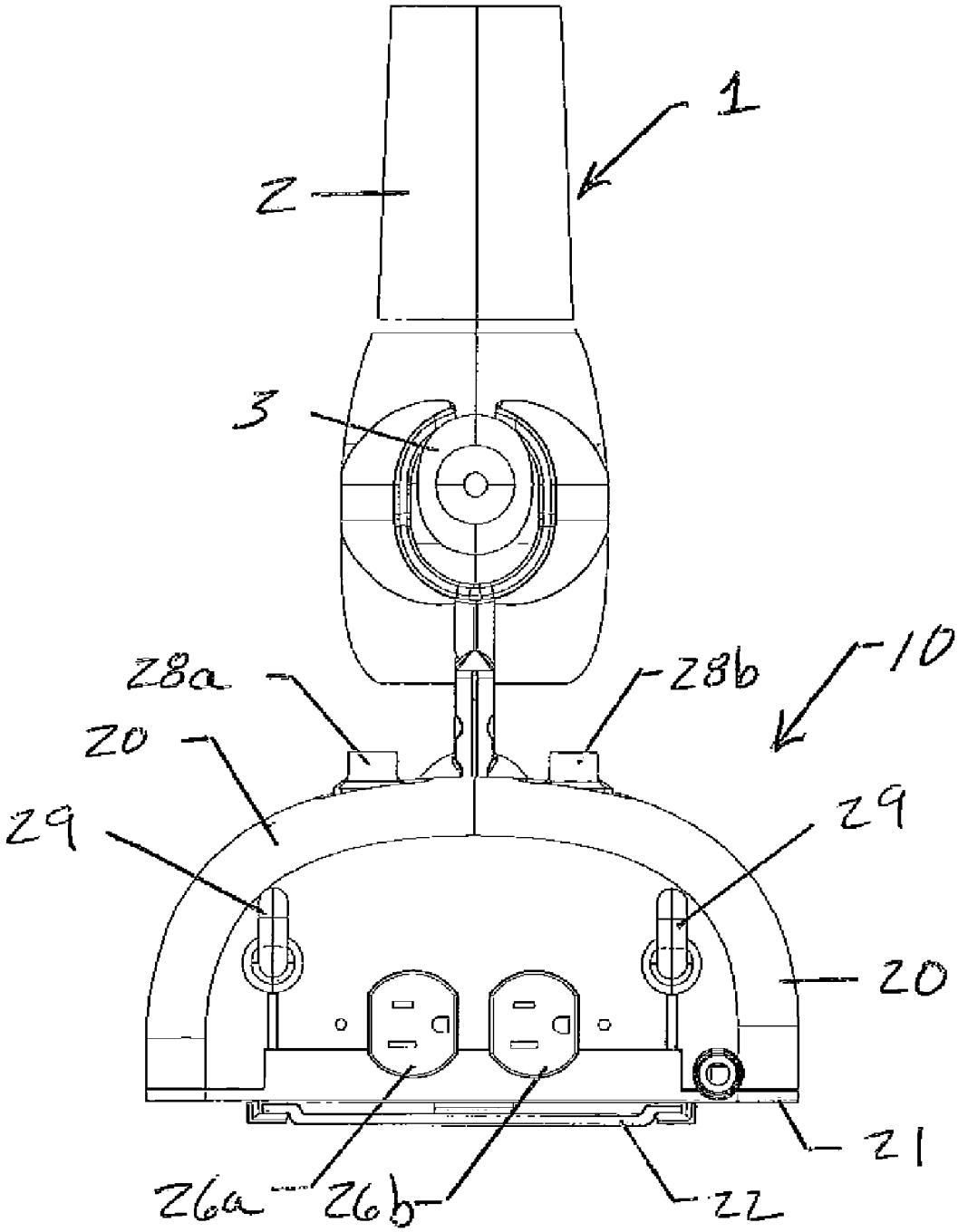
FIG. 5 is a bottom view thereof.

Housing 20 also includes an electrical receptacle, generally referenced as 26, having a first and second electrical outlets, referenced as 26*a* and 26*b*, accessible at the bottom of housing 20. In a preferred intended use, first outlet 26*a* is used to power the hair-dryer, and second outlet 26*b* is used to power an accessory device, such as a curling iron (not shown). An electrical power cord terminating in a Ground Fault Current Interrupt (GFCI) male electrical connector 23 projects from housing 20 and provides electrical power to receptacle 26 as shown in FIG. 2. Outlets 26*a* and 26*b* are controlled by on/off switches 28*a* and 28*b* respectively. In addition, the bottom of housing 20 included first and second downwardly projecting hooks. Hooks 29 are used to store accessory devices, such as a curling iron, suspended below housing 20.

Figure 13:
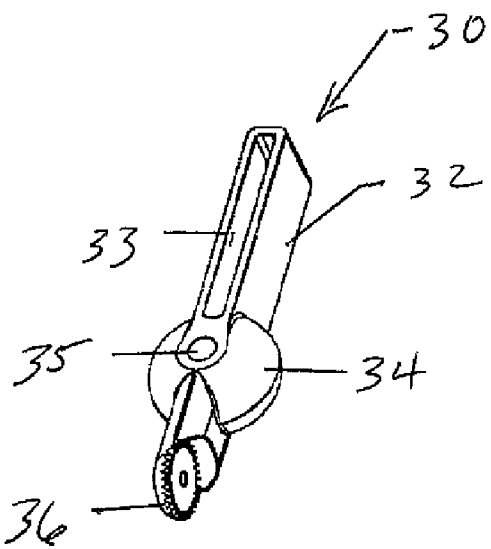
FIG. 13 is a top perspective view thereof
Figure 11:
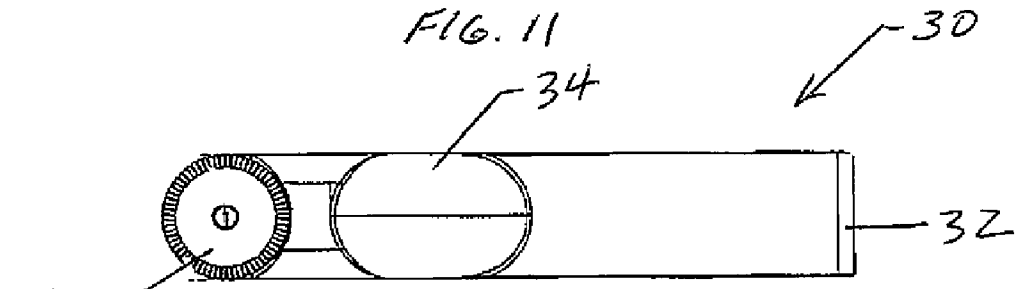
FIG. 11 is a side view of an oscillating arm of the present invention.
Figure 12:
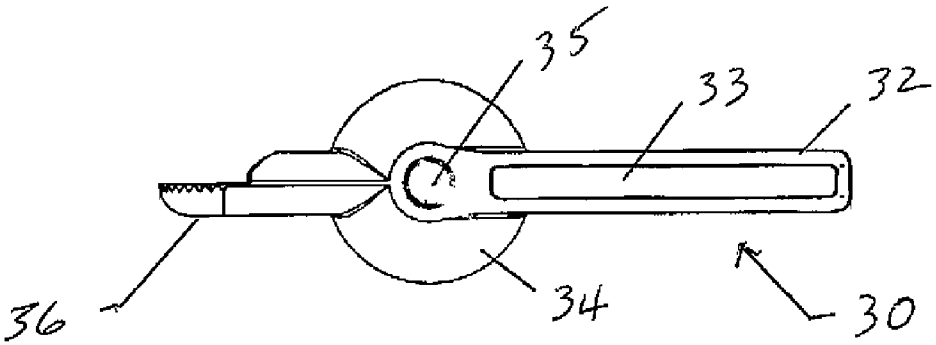
FIG. 12 is a top view thereof.

An oscillating arm 30 projects outward from housing 20 and is connected to a universal hair dryer holder 40 via a manually adjustable pivot connection 42. Oscillating arm 30 is connected to an electric motor contained within housing 20 and configured for side-to-side oscillation. An oscillation control lever 25 projects from housing 20 and is mechanically configured to allow for the manual selection and control of degree of angular oscillation, i.e. 90°, 135° etc. In a preferred embodiment, apparatus 10 is capable of achieving a full 180° angular oscillation. As best illustrated in FIGS. 11-13, oscillating arm 30 comprises an elongate structure having a proximal driven end 32 forming an elongated slotted aperture 33, a mid-portion 34 having a generally oval or circular outer surface defining a generally vertical thru bore 35, and a distal connectable end 36 for adjustable connectable engagement with hair dryer holder 40.

Universal hair dryer holder 40 is generally Y-shaped for receiving and holding any type, size, or style of handheld hair dryer without the aid of additional straps or fastening apparatus. As noted above hair dryer holder 40 is connected to oscillating arm 30 via a horizontal pivot connection 41 that allows for manual angular adjustment and affixation of the hair dryer about a generally horizontal pivot axis. In a preferred embodiment pivot connection 41 further includes a thumb actuated quick release mechanism that is spring biased to fix holder 40 relative to oscillating arm 30 to allow for quick and easy one-hand angular adjustment. This feature allows for simple angular vertical adjustment so that the apparatus may be quickly adapted for use by both tall and short individuals, or to accommodate use by a single individual in different positions e.g. standing or sitting. A significant aspect of hair dryer holder 40 involves its versatility, namely the ability to be used with a wide variety of makes and models of hair dryers without requiring adjustment. More particularly, hair dryer holder 40 is generally Y-shaped when viewed from the front, and includes partially cylindrical main body 42 wherein the distal end defines a generally vertical opening 43 and the proximal end includes a downwardly projecting wall 44 and a V-shaped top portion. V-shaped top portion 45 formed by upwardly and outwardly flared sides, referenced as 45*a* and 45*b* respectively, which function to cradle the main body 2 of hair dryer 1. An attachment arm 46 projects rearward from the distal end of main body 42 and is adapted for mating engagement with the connecting end 36 of oscillating arm 30. Hair dryer holder 40 receives a hair dryer handle within main body 42, while opening 43 allows the hair dryer electrical cord to pass through. The V-shaped top portion 45, and particularly flared sides 45*a* and 45*b*, defines a downwardly converging structure that functions to cradle the hair dryer main body and prevent sideways tipping. This feature is particularly important to provide lateral stability during oscillating movements, particularly in view of the forces experienced by the hair dryer upon change in oscillation direction. The downwardly projecting wall 44 functions as a stop that engages the hair dryer handle and prevents the hair dryer from tipping forward and out of the holder. As should now be apparent the V-shape is capable of receiving and cradling hair dryers having virtually any size body.

Figure 6:
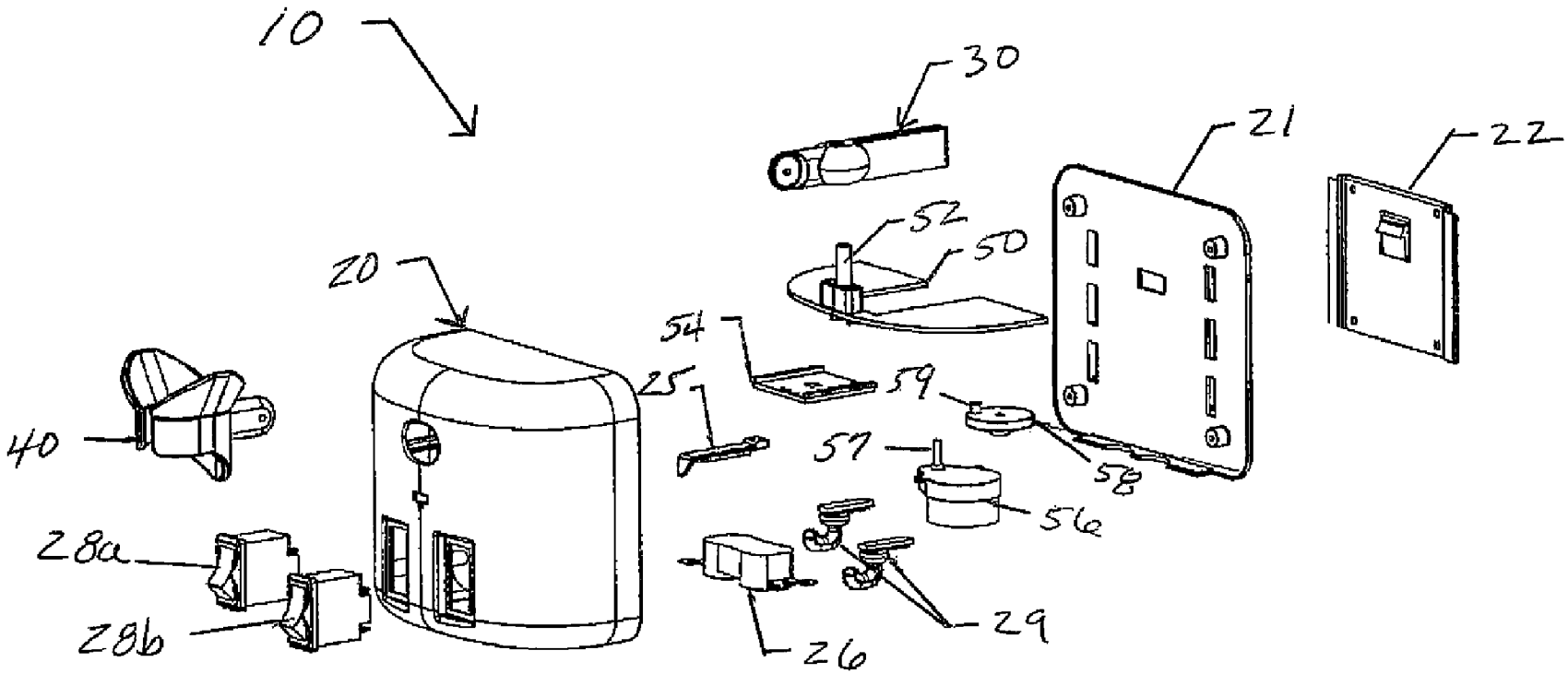
FIG. 6 is an exploded perspective view thereof.
Figure 10:
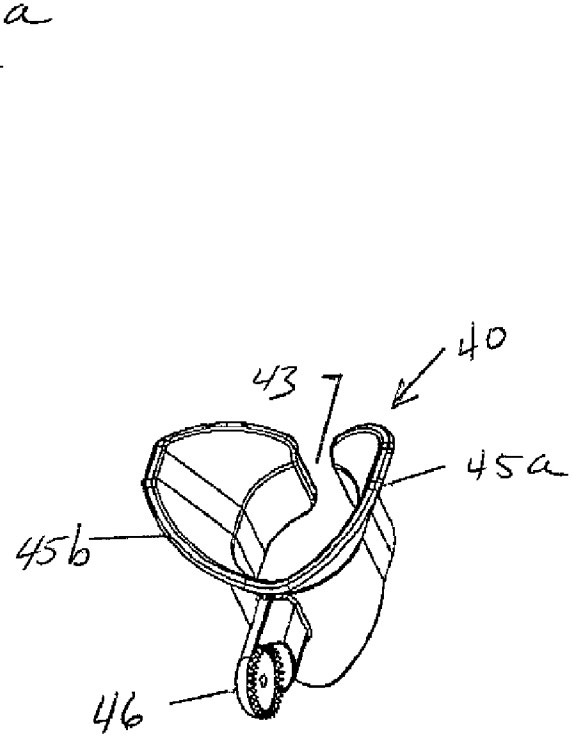
FIG. 10 is a top view thereof.
Figure 8:
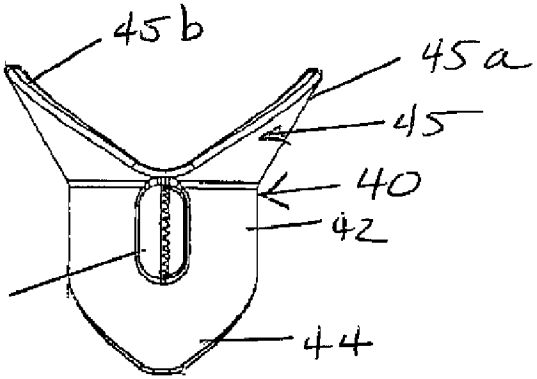
FIG. 8 is a rear view thereof.
Figure 7:
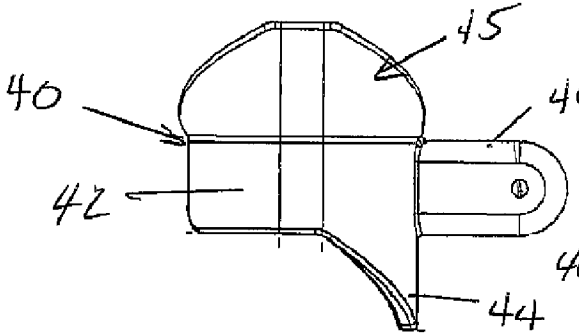
FIG. 7 is a side view of the universal hair dryer holder.
Figure 9:
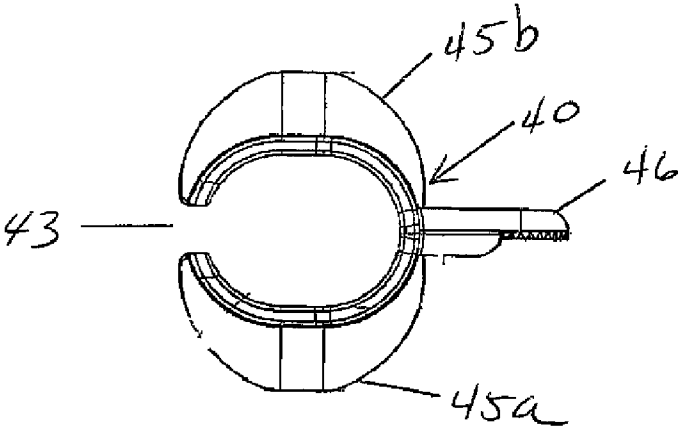
FIG. 9 is a bottom view thereof.

The oscillation mechanics will now be described. As best seen in FIG. 6, oscillating arm 30 extends partially into housing 20 is connected to an electric motor by mechanical linkage such that angularly adjustable side-to-side oscillation is enabled. Within housing 20 is a fixed plate 50 having an upward projecting shaft 52 which is received within thru bore 35 defiled in mid-portion 34 of oscillating arm 30 to provide a vertical pivot axis that allows for side-to-side pivotal movement of oscillating arm distal end 36 which in turn is pivotally connected to hair dryer holder 40 and a hair dryer mountably received within holder 40. A motor mount plate 54 having an electric motor 56 mounted thereon with the motor shaft 57 disposed vertically is in slidable engagement with fixed plate 50. A generally cylindrical wheel 58 having an eccentric shaft 59 projecting vertically therefrom is connected to shaft 57. Eccentric shaft 59 is received within elongated slotted aperture 33 on the driven end 32 of oscillating arm 30. Upon activation, motor 56 causes wheel 58 to spin whereby eccentric shaft 59 rides in aperture 33 thereby causing oscillation arm 30 to oscillate such that distal end 36 pivots from side-to-side.

A further significant aspect of the present invention involves providing an adjustment mechanism that allows the user to set the degree of angular oscillation. More particularly, oscillation control arm 25 has a proximal end connected to motor mount plate 54 and a distal end projecting from housing 20 and functions to allow the user to manually position motor mount plate 54. Positioning the motor mount plate rearward within housing 20 increases the distance between eccentric shaft 59 and the oscillation arm pivot point, namely shaft 52, thereby minimizing the degree of angular oscillation. In contrast, positioning the motor mount plate forward within housing 20 decreases the distance between eccentric shaft 59 and the oscillation arm pivot point thereby maximizing the degree of angular oscillation. Accordingly, the user can simply adjust the degree of angular oscillation by grasping control lever 25 and moving it in or out relative to housing 20. Thus angular adjustment is accomplished by providing the oscillating arm with an elongated longitudinal slot that receivably engages an eccentric motor driven axel, and by providing a manual adjustment lever that permits the user to selectively position the eccentric motor driven axel at various positions within the longitudinal slot thereby adjusting the angular displacement of the oscillating arm.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A hair dryer mounting apparatus for attachment to a vertical supporting surface for holding and oscillating a hair dryer, said apparatus comprising:

a mounting bracket for attachment to a vertical supporting surface;

a housing removably connectable to said mounting bracket;

an electric motor within said housing and configured with a generally vertically disposed eccentric output shaft, said motor movable within said housing between forward most and rearward most positions;

a control arm in slidable relation with said housing, said control arm having a proximal end configured to move said motor between said forward most and rearward most positions, and a distal end projecting from said housing;

an oscillating arm having a proximal end, a middle portion, and a distal end, said proximal end defining an elongated slotted aperture with said eccentric output shaft received within said aperture, said middle portion pivotally connected relative to said housing about a generally vertical pivot axis, said distal end projecting from said housing;

a hair dryer holder pivotally connected to said oscillating arm distal end to allow for manual angular adjustment of said holder about a generally horizontal pivot axis;

said hair dryer holder including a semi-cylindrical wall having a distal end defining a generally slotted opening, and the proximal end including a downwardly projecting wall portion, and a generally V-shaped top portion formed by upwardly and outwardly flared sides; and a power cord in electrical communication with said apparatus for providing electrical power.

2. A hair dryer mounting apparatus according to claim 1, wherein said housing further includes a first electrical outlet for powering a hair dryer, and a second electrical outlet for powering an accessory device.

3. A hair dryer mounting apparatus according to claim 2, further including a first on/off control switch for controlling the supply of electrical power to said first electrical outlet, and a second on/off control switch for controlling the supply of electrical power to said second electrical outlet.

4. A hair dryer mounting apparatus for attachment to a vertical supporting surface for holding and oscillating a hand-held hair dryer, said apparatus comprising:

a mounting bracket for attachment to a vertical supporting surface, said mounting bracket having a spring clip;

a housing removably connectable to said mounting bracket and slidably configurable between a connected configuration wherein said spring clip engages said mounting bracket to a disconnected wherein said spring clip disengages from said mounting bracket;

an electric motor within said housing and configured with a generally vertically disposed eccentric output shaft, said motor mounted to a plate, said plate being slidably movable within said housing between forward most and rearward most positions;

a control arm in slidable relation with said housing, said control arm having a proximal end and a distal end, said control arm proximal end connected to said plate to allow the user move said motor between said forward most and rearward most positions, said control arm distal end projecting from said housing;

an oscillating arm having a proximal end, a middle portion, and a distal end, said proximal end defining an elongated slotted aperture with said eccentric output shaft received within said aperture, said middle portion pivotally connected relative to said housing about a generally vertical pivot axis, said distal end projecting from said housing;

a hair dryer holder pivotally connected to said oscillating arm distal end to allow for manual angular adjustment of said holder about a generally horizontal pivot axis;

said hair dryer holder including a semi-cylindrical wall having a distal end defining a generally slotted opening, and the proximal end including a downwardly projecting wall portion, and a generally V-shaped top portion formed by upwardly and outwardly flared sides;

at least one accessory holding hook projecting from said housing;

a power cord in electrical communication with said apparatus for providing electrical power, said power cord terminating in a GFCI electrical connector.

5. A hair dryer mounting apparatus according to claim 4, wherein said housing further includes a first electrical outlet for powering a hair dryer, and a second electrical outlet for powering an accessory device.

6. A hair dryer mounting apparatus according to claim 5, further including a first on/off control switch for controlling the supply of electrical power to said first electrical outlet, and a second on/off control switch for controlling the supply of electrical power to said second electrical outlet.

* * * * *